US006317925B1

(12) United States Patent
Pietryga et al.

(10) Patent No.: US 6,317,925 B1
(45) Date of Patent: Nov. 20, 2001

(54) HINGE TRIM SYSTEM

(75) Inventors: Brad L Pietryga, Shelby Township; Jason E Lowery, Rochester Hills, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/561,891

(22) Filed: May 1, 2000

(51) Int. Cl.[7] ..... E05D 11/00
(52) U.S. Cl. ..... 16/250; 16/251; 49/383
(58) Field of Search ..... 49/383; 16/250, 16/251

(56) References Cited

U.S. PATENT DOCUMENTS 2,919,460 * 1/1960 Arnold ..... 16/250
3,319,697 * 5/1967 Krohn ..... 16/250
3,651,540 * 3/1972 Rana ..... 16/251
5,001,862 * 3/1991 Albenda ..... 16/251
5,244,247 9/1993 Kuwabara .

* cited by examiner

*Primary Examiner*—B. Dayoan
*Assistant Examiner*—Aaron Dunwoody
(74) *Attorney, Agent, or Firm*—Jeffrey A. Sedlar; Laura C. Hargitt

(57) ABSTRACT

A hinge trim system including a covering portion overlying at least a portion of at least one of the exposed surfaces of a hinge, wherein the covering portion can include one or more covering surfaces overlying the hinge so as to maintain a barrier surface between one or more pivot points and the covering portion. Additionally, selected portions of the covering portion move as the hinge moves so as to maintain a barrier surface over a substantial portion of the hinge as the hinge moves from one position to another.

13 Claims, 7 Drawing Sheets

HINGE TRIM SYSTEM

FIELD OF THE INVENTION

The present invention is directed to an apparatus for covering a hinge. More particularly, the present invention relates to a hinge trim system that permits the hinge trim to move simultaneously with the hinge while maintaining a covering over a substantial portion of the hinge regardless of the hinge's position.

BACKGROUND OF THE INVENTION

In the field of automotive design, it is desirable in some instances to provide a covering over a hinged surface. Generally, hinge covering systems are used for aesthetic purposes and to help reduce the likelihood of contact with the hinge.

U.S. Pat. No. 5,244,247 ("the '247 patent") describes some prior art hinge covering systems used for automobile door systems. One door installation arrangement includes a door body that is pivotally connected to a vehicle body by a double hinge member having a dash side member. The double hinge member is hingedly connected at one end section to the front end section of the door body and hingedly connected at the other end thereof to the rear end face of the dash side member. A door trim is attached to the door body on the side of a passenger compartment, and a dash side trim is attached to the dash side member on the passenger compartment side. A hinge trim is also attached to the double hinge ember on the passenger side of the compartment. With this arrangement, it is necessary to form a space between the hinge trim and the door body by rounding off the end of the hinge trim in order to prevent interference of the hinge trim with the door body, particularly when the door body is opened to be in parallel with the longitudinal direction of the vehicle body. Rounding the end of the hinge trim may result in the exposure of a pivot point.

Another hinge trim system described in the '247 patent is used with a double hinge member having a first end section hingedly connected to a door body of the vehicle. A second end section of the double hinge member is hingedly connected to the body of the vehicle.

The hinge trim is movably disposed on an inboard side of and separate from the double hinge member. The hinge trim has first and second end sections. A second hinge member is provided such that the first end section of the hinge trim is hingedly connected to a door trim through the second hinge member. Additionally, a sub-hinge member is provided such that the second end section of the trim is connected to a member in close proximity to the vehicle body through the sub-hinge.

The hinge trim is disposed separate from the double hinge member and movable independently from the double hinge member. Additionally, the opposite end sections of the hinge trim are respectively connected to the vehicle body and the door body side through a sub-hinge member and the hinge member. As a result, additional components are needed to complete installation of this hinge trim system.

There is needed a hinge trim covering system that permits a substantial portion of the hinge, particularly at pivot points, to remain at least partially covered regardless of the position of the hinge.

SUMMARY OF THE INVENTION

The present invention relates to a hinge trim system. In general, the hinge trim can include a covering portion overlying at least a portion of at least one of the exposed surfaces of a hinge, wherein the covering portion includes one or more covering surfaces overlying the hinge so as to maintain a barrier surface between one or more hinge pivot points and the covering portion. Additionally, selected portions of the covering portion move as the hinge moves so as to maintain a barrier surface over a substantial portion of the hinge, particularly at pivot points, as the hinge moves from one position to another.

In another embodiment, the hinge trim system includes a covering portion having a first covering portion positioned adjacent a second covering portion, wherein the first covering portion and the second covering portion can be selectively moved to maintain a barrier surface over one or more hinge pivot points as the hinge moves from one position to another. The hinge can also be constructed to permit selective movement of the first covering portion and/or the second covering portion simultaneously with the hinge while maintaining a barrier surface over one or more hinge pivot points as well as a substantial portion of the hinge's surface.

In another embodiment, the combination hinge and hinge trim arrangement includes a hinge including a support link having a first end pivotally connected to a first strap and having a second end pivotally connected to a second strap, the first strap having a first substantially planar mounting segment and the second strap having a second substantially planar mounting segment, the first and second mounting segments continuously remaining substantially parallel during operation of the hinge system; and a hinge trim system for covering one or more exposed surfaces of the hinge, including (1) a first covering portion overlying the support link; (2) a second covering portion adjacent the first covering portion overlying the first strap; and (3) a third covering portion adjacent the first covering portion overlying the second strap, wherein the first covering portion moves with the hinge relative to the second covering portion and the third covering portion so as to maintain a barrier surface between respective adjacent end portions of the first covering portion, the second covering portion, and the third covering portion and the hinge while simultaneously maintaining a covering over a substantial portion of the hinge surfaces.

A method for installing the hinge and hinge trim assembly on a door of an automobile frame can include the steps of (1) providing a door to be hinged to an automobile frame; (2) coupling a hinge to one surface of the door; (3) coupling the opposite end of the hinge to a portion of the automobile frame; (4) and providing a hinge trim having a covering portion for covering at least a portion of one or more exposed surfaces of the hinge, wherein the covering portion includes one or more covering surfaces overlying the hinge so as to maintain a barrier surface between one or more pivot points and the covering portion.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
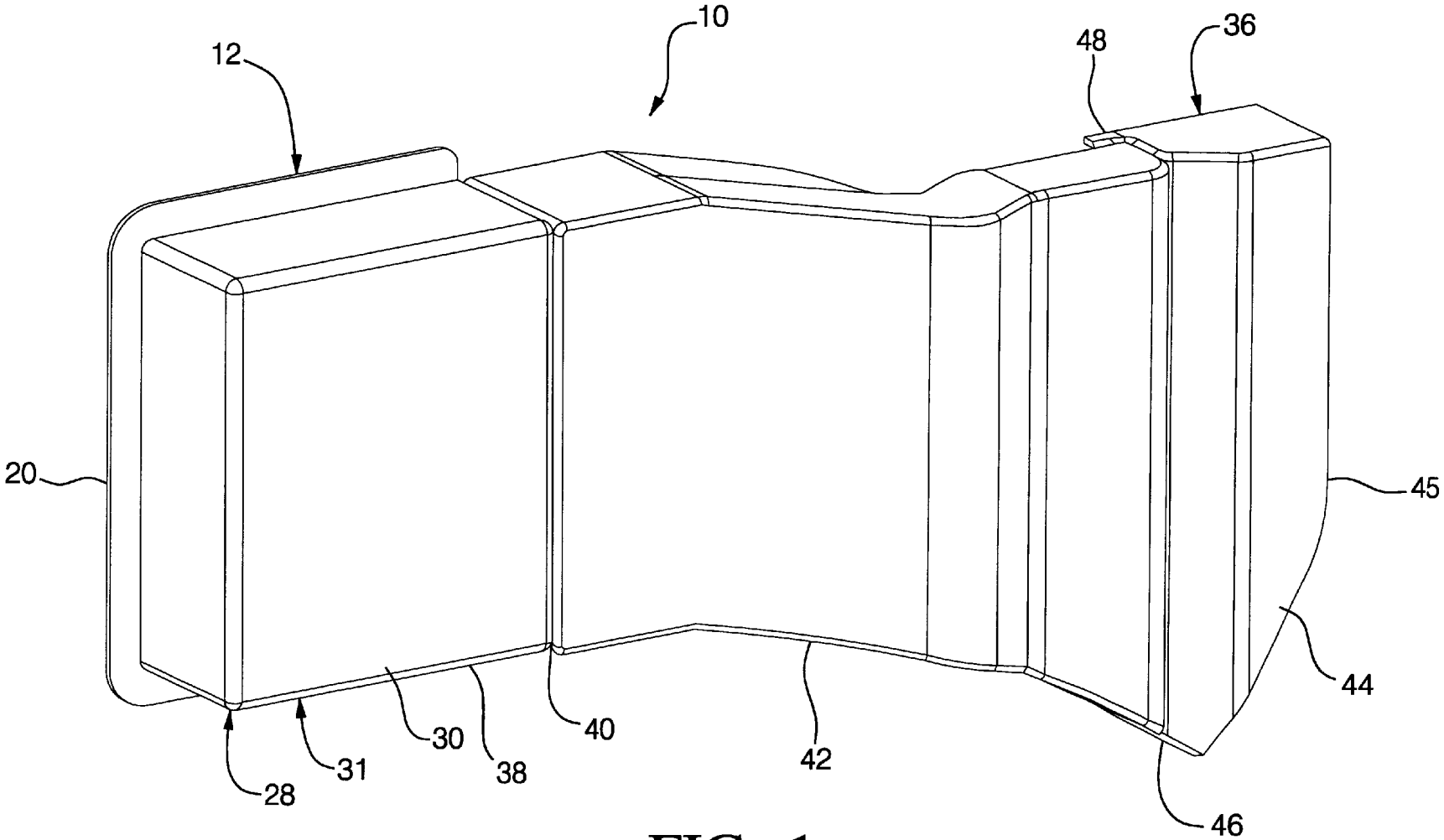
FIG. 1 is a perspective view of a hinge trim system formed in accordance with the teachings of this invention.

FIG. 1 illustrates a hinge trim system in general form designed in accordance with the teachings of the present invention. Regardless of the type and construction of the hinge to be covered, the hinge trim system includes a covering section overlying one or more exposed surfaces of the hinge. In the most general form, the hinge trim system includes a covering portion overlying at least a portion of at least one of the exposed surfaces of the hinge. The covering portion can include one or more covering surfaces overlying the hinge so as to maintain a barrier surface between one or more pivot points and the covering portion. Selected portions of the covering portion can move as necessary to follow the movement of the hinge so as to maintain a barrier surface between one or more pivot points and the covering portion.

Figure 6:
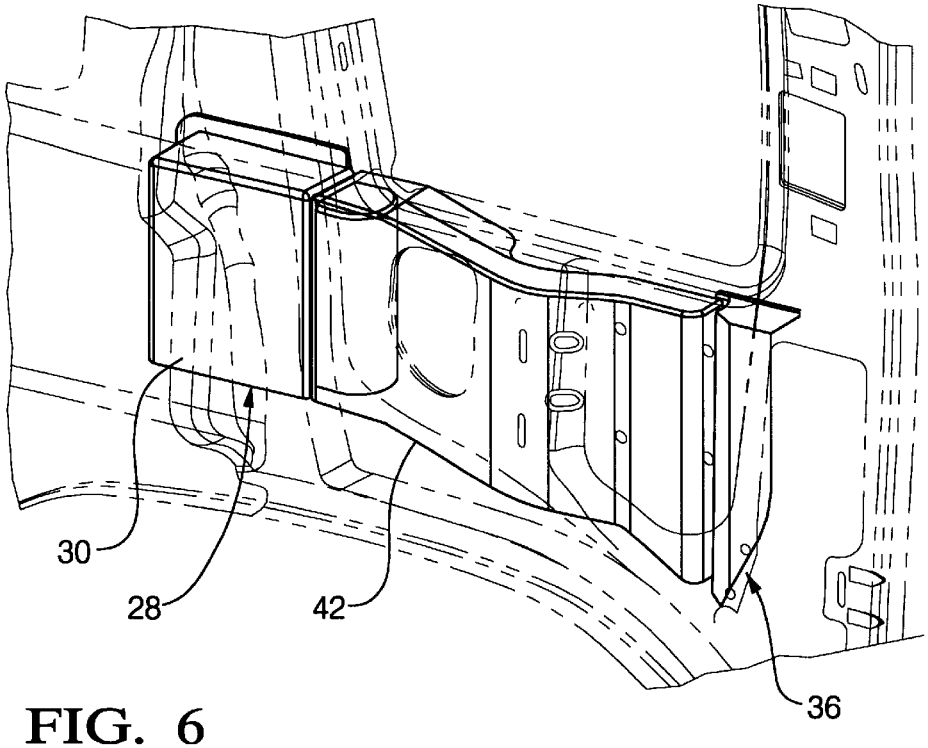
FIG. 6 shows an assembly of the hinge trim of FIG. 1 and the hinge of FIG. 2 installed on an automobile doorframe, wherein the door is in the closed position.
Figure 7:
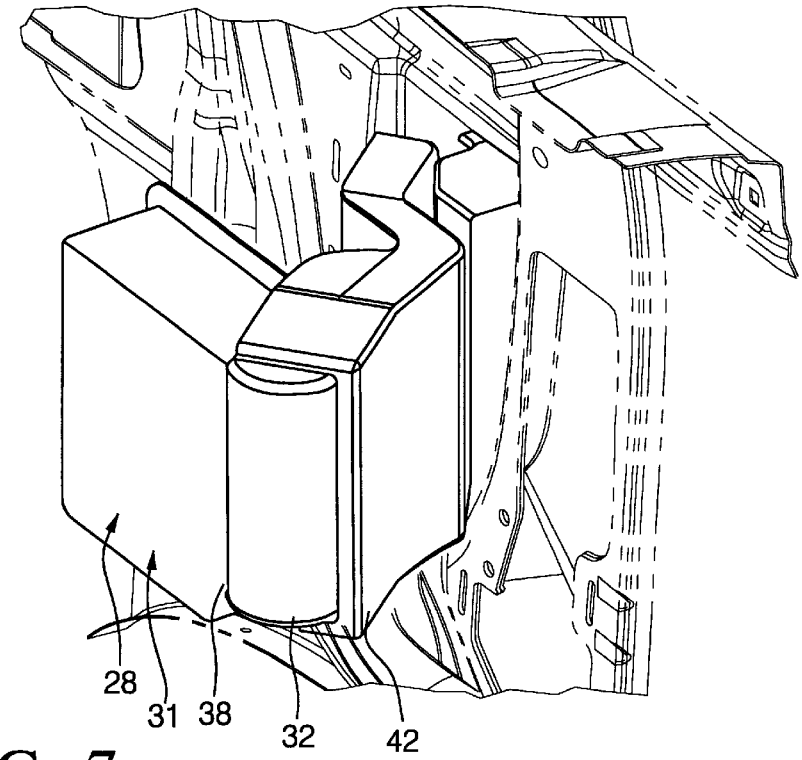
FIG. 7 shows an assembly of the hinge trim of FIG. I and the hinge of FIG. 2 installed on an automobile doorframe, wherein the door is in the open position.

The hinge trim system 10 of the present invention can be used in a variety of applications, particularly where it is desirable to provide a covering over a hinged surface. For illustration purposes, the hinge trim system 10 will be described with reference to covering a hinge installed on the door and body portion of an automobile as illustrated in FIGS. 6 and 7.

Figure 2:
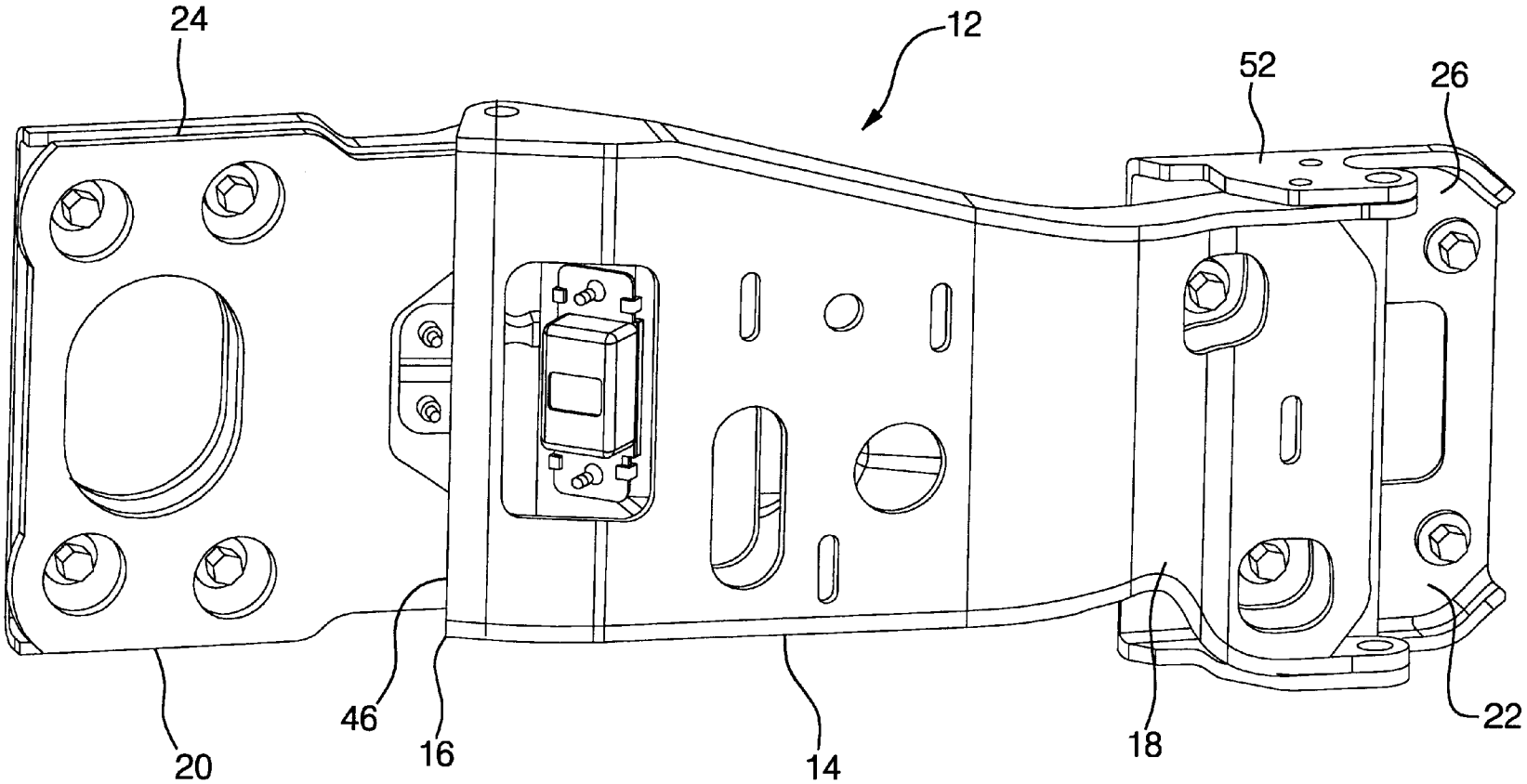
FIG. 2 is a perspective view of a hinge assembly formed in accordance with the teachings of this invention.

In a preferred embodiment, the hinge trim system 10 of the present invention is used to cover a hinge 12, best seen in FIG. 2. The hinge 12 is of the type disclosed in a U.S. Pat. No. 6,196,618, issued Mar. 6, 2001 entitled "Hinge System", filed concurrently herewith and incorporated herein by reference. The hinge 12 includes a central support link 14 having a first end 16 pivotally connected to a body side mounting strap 20 and a second end 18 pivotally coupled to a door side mounting strap 22. The body side mounting strap 20 can include a first substantially planar mounting segment 24, and the door side mounting strap 22 can also include a second substantially planar mounting segment 26 such that the first and second mounting segments 24, 26 continuously remain substantially parallel to one another during operation of the hinge 12.

The hinge trim system 10 used to cover the hinge 12 can include three major components: a body side mounting strap covering portion 28, a door side mounting strap covering portion 36, and a central support link covering portion 42. These elements can be fabricated of a metal or plastic material having the capability of withstanding the wear and tear of use in an automobile, particularly a passenger vehicle. In a preferred embodiment, the components of the hinge trim system 10 are formed of a plastic material, with the preferred material being polypropylene. One of ordinary skill in the art will appreciate that the major components of the hinge trim system 10 can be formed using generally known molding techniques such as injection molding.

Turning now to a discussion of the components of the hinge trim system 10, the body side mounting strap covering portion 28 includes a substantially planar portion 31 as shown in FIG. 1. The substantially planar portion 31 includes a substantially planar top portion 30. The substantially planar top portion 30 can form a slip plane 66 (discussed below) or excessive clearance at the interface between the body side mounting strap covering portion 28 and the door and body interior trim panels due to necessary adjustment of the hinge 12. This configuration helps to reduce interference between the interior trim panels and the body side mounting strap covering portion 28.

Figure 3:
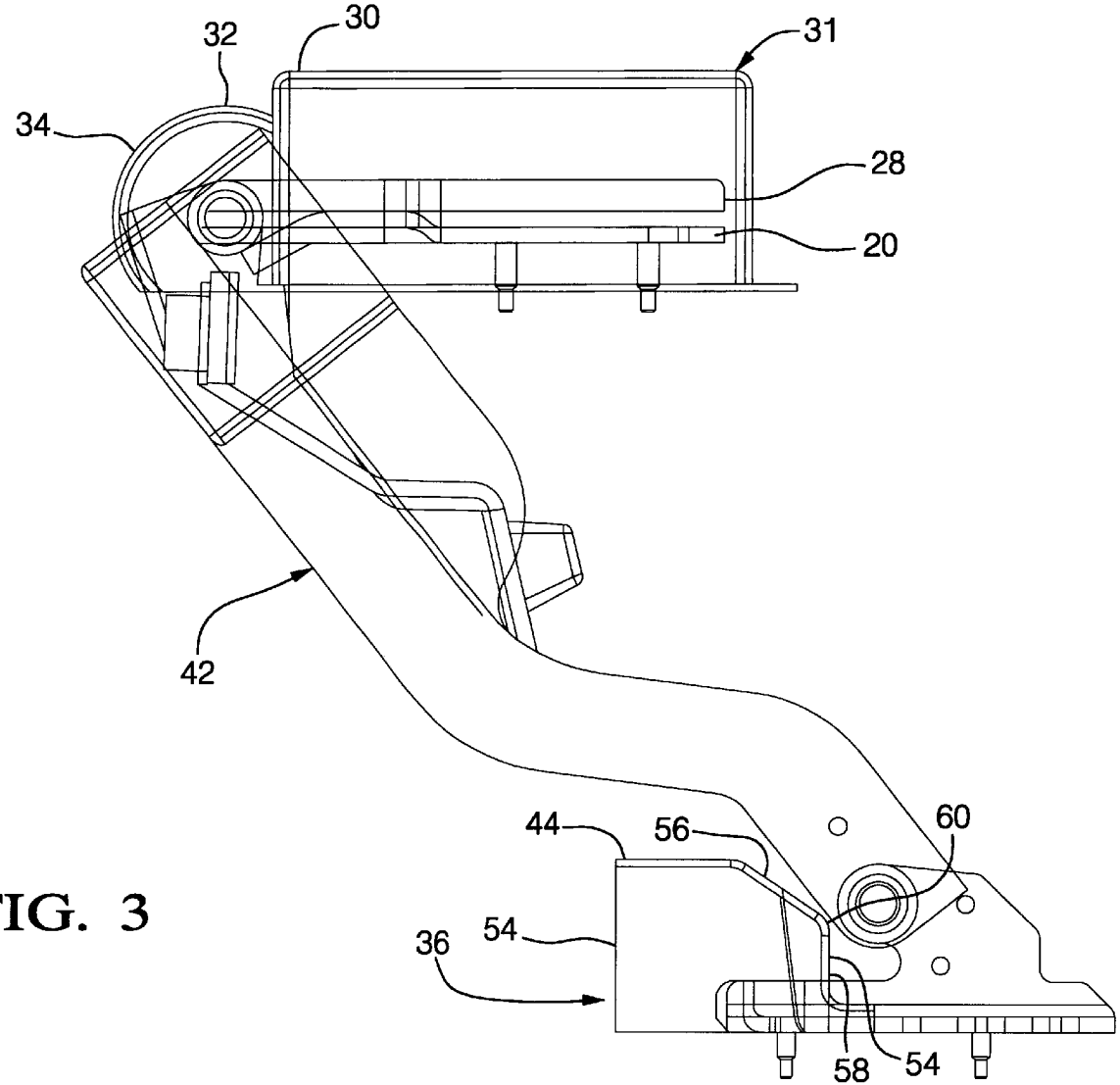
FIG. 3 is an elevational view of the hinge trim system of FIG. 1 installed on the hinge of FIG. 2, wherein the hinge is shown in an open position.
Figure 4:
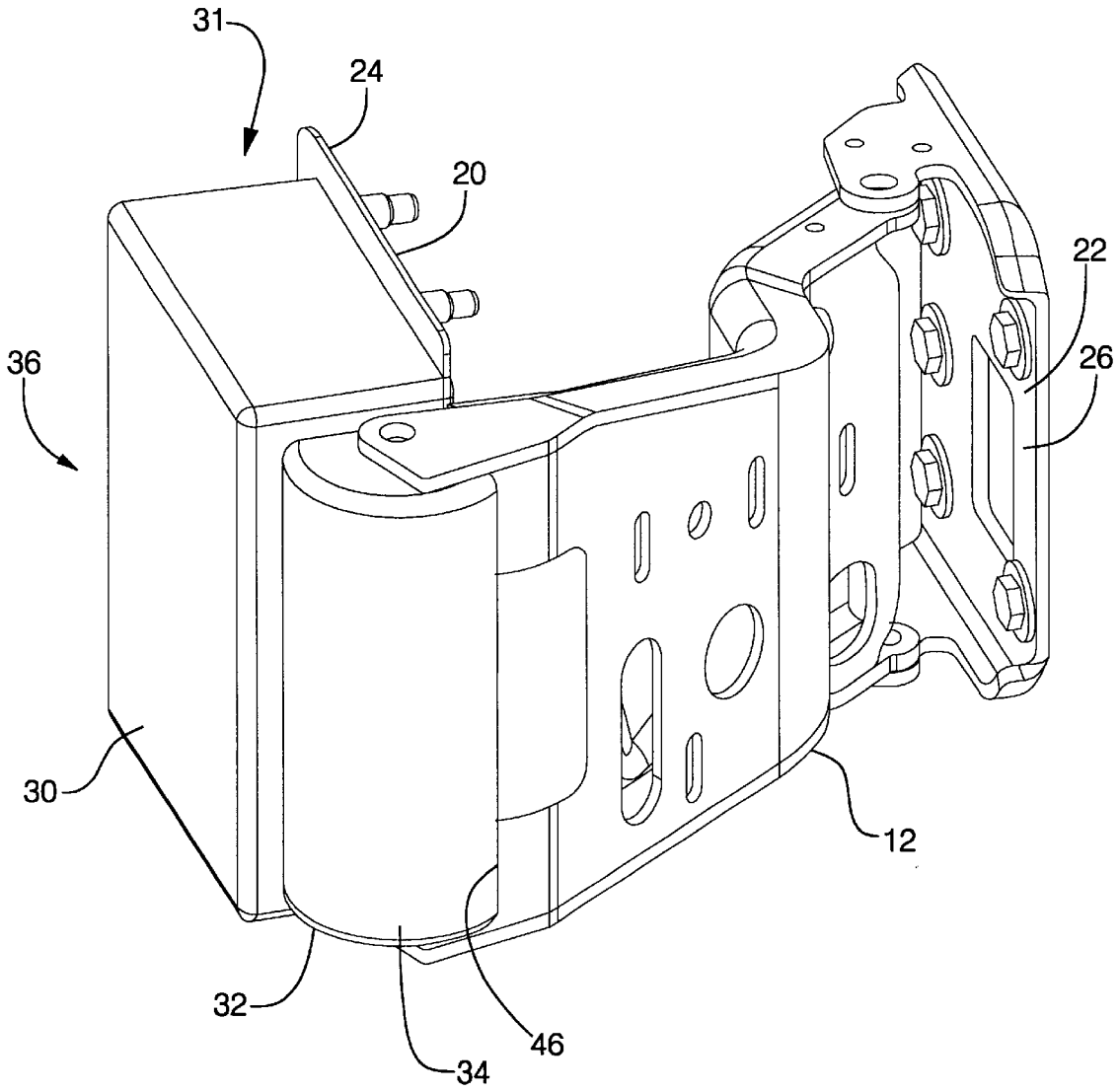
FIG. 4 is a perspective view of the body side mounting covering portion of the hinge trim system shown in FIG. 1 installed on a portion of the hinge shown in FIG. 2.

The surface opposing the planar top portion 30 supports a fastening clip (not shown), whereas the planar top portion 30 faces inwardly toward the passenger compartment where it might be exposed to vehicle occupants. One end 38 of the substantially planar top portion 30 supports an extension 32 as best seen in FIGS. 3 and 4. The extension 32 includes opposing longitudinally extending side wall surfaces joined by a radial surface portion 34.

Figure 5:
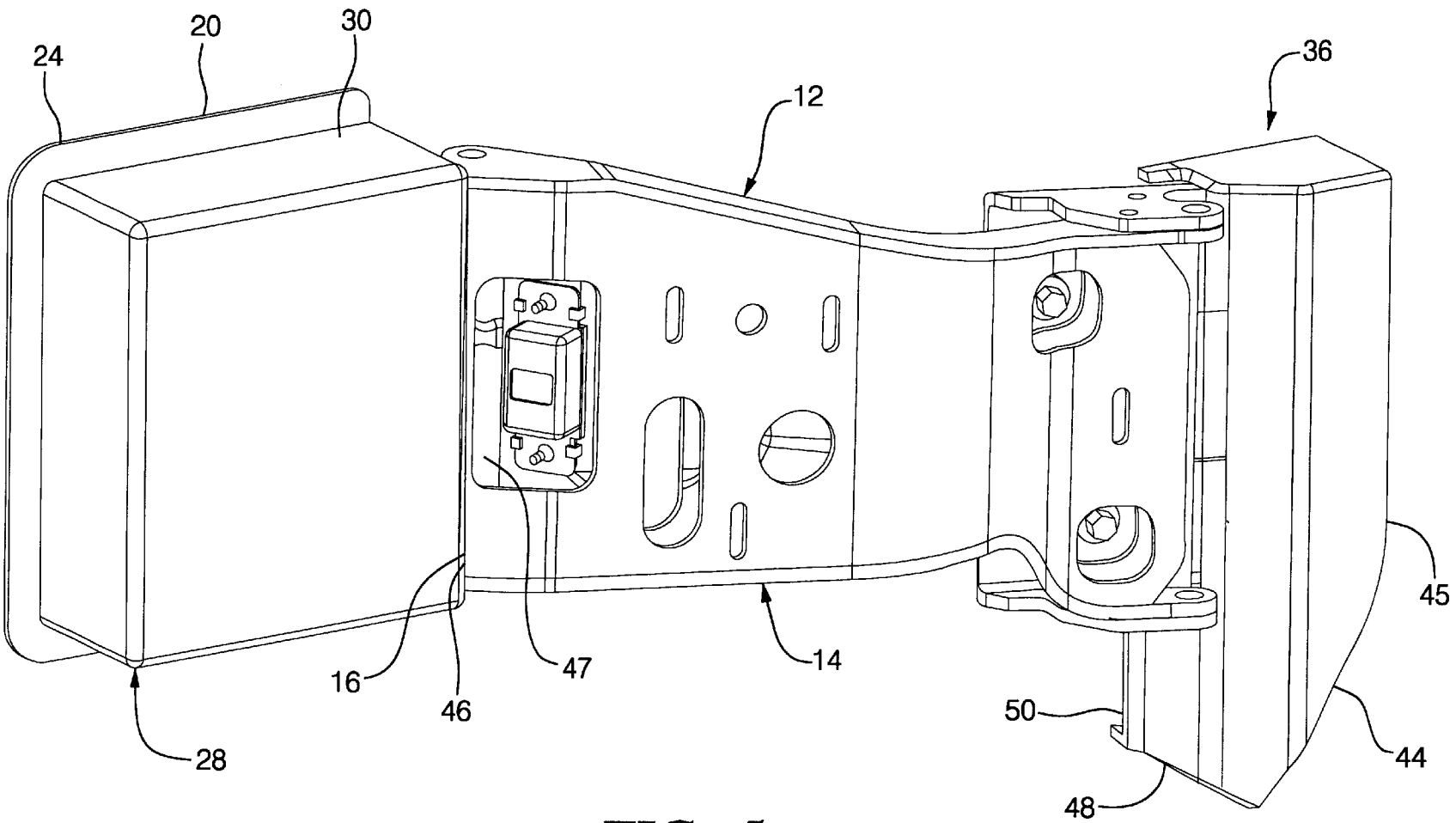
FIG. 5 shows the installation of a portion of the hinge trim of FIG. 1 installed on the hinge of FIG. 2.

The door side mounting strap covering portion 36, as illustrated in FIG. 5, can include a body portion 44 having a substantially planar top surface 45. The substantially planar top surface 45 of the body portion 44 forms a slip plane 66 (discussed below) or excessive clearance at the interface with interior trim panels due to necessary adjustment of the hinge 12 during installation of the door to which the hinge 12 is mounted or during movement of the hinge 12, thus helping to reduce potential interference between the covering portion 36 and interior trim panels.

The body portion 44 also includes an extended lower edge portion 50 projecting outwardly therefrom. When installed on an automobile frame, the inwardly facing surfaces of the body portion 44 can be exposed to the passenger compartment as shown in FIGS. 6 and 7. The outwardly facing surfaces of both the extended lower edge portion 50 and the body portion 44 can support one or more fastening clips (not shown).

The body portion 44 also includes a side wall portion 54 having an inclined surface portion 56 that intersects an upwardly extending portion 58. An outwardly projecting protrusion 60 is formed at the intersection of the inclined surface portion 56 and the upwardly extending portion 58.

As shown in FIGS. 1 and 3, the central support link covering portion 42 can be unitary structure having a substantially planar top surface. The outer surface of the central support link covering portion 42 can support one or more fastening clips for coupling the central support link covering portion 42 to the hinge 12. The inwardly facing surface of the central support link covering portion 42 is a smooth continuous surface, and faces inwardly toward the passenger compartment when installed on an automobile as best seen in FIGS. 6 and 7.

Assembly and Operation

As described above, the hinge trim system 10 is essentially a three component system. Each hinge 12 covering portion 28, 36, and 42 can be attached to its corresponding hinge 12 component 14, 20 or 22, allowing for tight control of gaps between each of the hinge 12 components 14, 20 and 22 and each trim covering portion 28, 36, and 42 throughout the travel of the hinge 12 regardless of the adjusted position of the body or door mounting interface.

In one embodiment, the hinge trim system 10 can frictionally engage the hinge 12 such that selected portions of the hinge trim system 10 can move simultaneously with the hinge 12, as the hinge 12 permits a full range of movement of the vehicle door, i.e., closed, partially open or fully open. As the hinge 12 moves, the hinge trim system 10 maintains a covering over a substantial portion of the hinge 12 as well as pivot points or other gaps or potential pinch points formed due to opening and closing the vehicle door. The following description illustrates one method for assembling the hinge trim system 10 onto the hinge 12. One of ordinary skill in the art will appreciate that the order of assembling the components can be varied.

The installation of the hinge trim system 10 can be accomplished by first coupling the body side mounting strap covering portion 28 to the body side mounting strap portion 20 of the hinge 12. As shown in FIG. 5, the extension 32 of the body side mounting strap covering portion 28 is received in an opening 47 formed in the hinge assembly 12.

Next, the fastening clip supported by the body side mounting strap covering portion 28 can snap onto a mating bracket defined by the body side mounting strap portion 20. The frictional engagement of the fastening clip and the bracket creates a frictional lock that securely holds the body side mounting strap covering portion 28 in position on the hinge 12. One of ordinary skill in the art will appreciate that other methods can be used to couple the body side mounting strap portion 20 and the body side mounting strap covering portion 28. For instance, the body side mounting strap covering portion could support threaded mounting studs that engage a threaded opening formed in the body side mounting strap 20. When fully installed, the body side mounting strap covering portion 28 covers the door side mounting strap 20 and at least a portion of the door side mounting strap mounting segment 24.

Turning now to the door side mounting strap covering portion 36, the door side mounting strap covering portion 36 overlies the door side mounting strap 22, as well as a portion of the door side mounting segment 26, as shown in FIG. 3. The extended lower edge portion 50 of the door side mounting strap covering portion 36 extends slightly over the end portion 52 of the mounting segment 26.

The door side mounting strap covering portion 36 snaps onto the door side mounting strap 22 in the manner previously described for the body side mounting strap covering portion 28. The frictional engagement between the fastening clip supported by the underside of the door side mounting strap covering portion 36 and a bracket supported by the door side mounting strap 22 securely couples the door side mounting strap covering portion 36 in position on the hinge 12.

Finally, the central link support covering portion 42 is disposed between the door side mounting strap covering portion 36 and the body side mounting strap covering portion 28. As shown in FIG. 1, the top surfaces of each covering portion 28, 36, and 42 are substantially flush.

When the vehicle door is closed, FIG. 1, one end of the central link support covering portion 42 overlies the radial surface 34 of the body side mounting strap covering portion 28 and the opposite end overlies the extended lower edge portion 50 of the door side mounting strap covering portion 36.

The central link support covering portion 42 is coupled to the central support link 14 in the manner previously described for the body side mounting strap covering portion 28. That is, a fastening clip supported by the outwardly facing surface of the central support link covering portion 42 snaps onto a bracket supported by the central support link 14. This arrangement permits the central support link covering portion 42 to move simultaneously with the hinge 12 to help maintain a barrier surface between the central support link covering portion 42 and the hinge pivot points. This arrangement also permits the central support link covering portion 42, the body side mounting strap covering portion 28, and the door side mounting strap covering portion 36 to maintain a covering over a substantial portion of the hinge 12 regardless of the position of the hinge 12. This arrangement further permits the central support link 14 to move relative to the end portions of the door side mounting strap cover portion 36 and the body side door mounting covering portion 28 so as to help reduce the width and depth of gaps that might be formed between the adjacent ends of the covering portions 28, 36 and 42 as the hinge 12 moves from one position to another as illustrated in FIGS. 3, 6, and 7. For example, in the disclosed embodiment, when the door is in the open position, one end of the central support link covering portion 42 is rotated toward the protrusion 60 of the door side body strap covering portion 36 as best seen in FIG. 3. Thus, controlling the dimensions of the respective components can help to control the dimensions of any opening that might be formed between the protrusion 60 and the end of the central support link covering portion 42.

In the disclosed embodiment, when each of the covering portions 28, 36 and 42 are in position on the hinge 12, a seam 40 is formed between the adjacent surfaces of the end 38 and the extension 32, and a seam 46 is formed between an end 48 of the door side mounting strap covering 36 and the central link support strap covering 42. The covering portions 28, 36 and 42 are sized to help minimize the depth and width of the seams 40, 46 in order to help reduce the potential for entrapment of foreign objects in the seams 40, 46 as the covering portions move with the hinge 12 regardless of the adjusted position of the vehicle or door mounting interface.

Additionally, due to manufacturing variations of the door, body and the hinge 12, it may be necessary to have a means of adjusting the door to fit the body opening. This can be accomplished by providing slip planes 66 at the door and body hinge 12 mounting surfaces 14, 20 and 22. The slip planes 68, 70 permit fore/aft and vertical adjustment of the hinge 12 as necessary to permit the door to be fitted within the body opening. Cross-car adjustments can be accomplished by pivoting the hinge 12 to the desired orientation.

Figure 8:
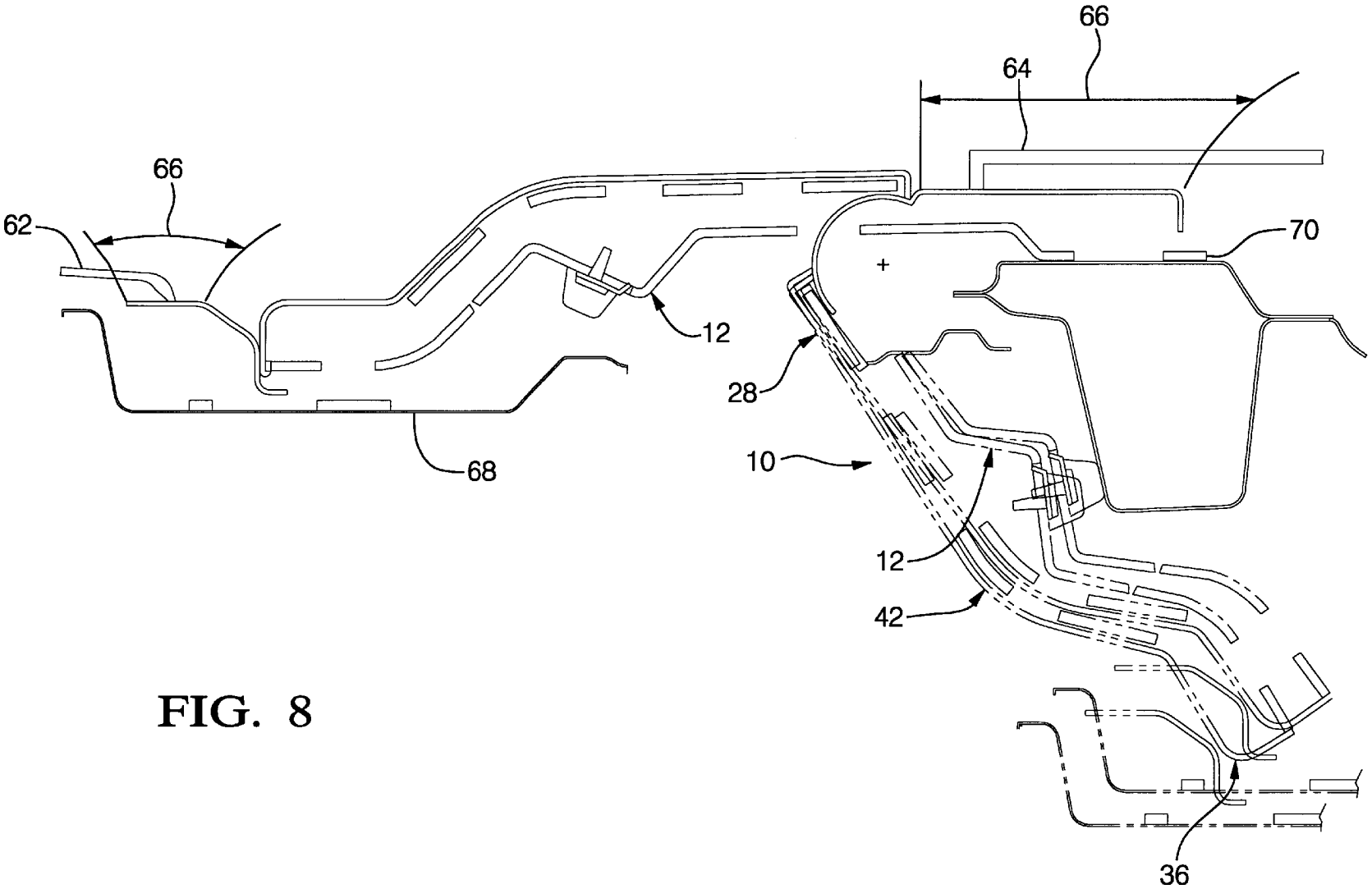
FIG. 8 illustrates one location for slip planes that can be formed between the hinge shown in FIG. 1 and interior trim panels as the hinge is repositioned from a closed position to partially and fully open positions.

For example, if the door and body mounting bracket covering portions 28, 36 were incorporated into the major door and rear quarter trim panels 62, 64, as shown in FIG. 8, additional clearance may be needed to allow for the adjustment of the hinge 12 relative to the particular mounting surface involved. Additional clearance may also be required due to the positional variation of the major trim panels relative to the door and body.

The additional clearance required by incorporating the mounting bracket covering portions 28, 36 to the major trim panels 62, 64 may result in excessive gaping at the hinge 12 pivot points, increasing the possibility of creating a pinch point and allowing for visibility of non-styled components that the hinge trim system 10 is designed to hide. In addition, the areas around the hinge 12 pivot points can be tightly constrained to help prevent pinch points which could limit styling freedom and possibly limit the overall travel of the hinge 12.

To account for the positional variation of the major trim panels 62, 64 relative to the door and body, the mounting bracket covering portions 28, 36 can attach directly to the hinge mounting brackets 24, 26. Slip planes 66 are then used at the interface between the bracket covering portions 28, 36 and the major door and body interior trim panels. The slip planes 66 are located away from areas that may be likely to come into contact with components of the swinging door system, thus helping to reduce the sensitivities resulting from major (door or body) trim to mounting bracket trim relative movement due to variation or normal door to body adjustment.

This design results in coverage of an exposed hinge 12 that helps minimize gaps resulting from the necessary adjustability of the hinge 12.

The preferred embodiments of the present invention have been disclosed. A person of ordinary skill in the art would realize, however, that certain modifications would come within the teachings of this invention. For instance, the body side mounting strap covering portion 28 and the door side mounting strap covering portion 36 could be formed having planar top surfaces rather than substantially planar top surfaces as described herein. Therefore, the following claims should be studied to determine the true scope and content of the invention.

What is claimed:

1. A hinge trim system comprising a covering portion overlying at least a portion of at least one of the exposed surfaces of a hinge, wherein the covering portion includes one or more covering surfaces overlying the hinge so as to maintain a barrier surface between one or more pivot points and the covering portion and wherein a slip plane is formed between the covering portion and the exposed surfaces of the hinge.

2. A hinge trim system comprising a covering portion overlying at least a portion of at least one of the exposed surfaces of a hinge, wherein the covering portion includes one or more covering surfaces overlying the hinge so as to maintain a barrier surface between one or more pivot points and the covering portion and wherein the hinge includes a support link having a first end pivotally connected to a first strap and having a second end pivotally connected to a second strap, the first strap having a first mounting segment and the second strap having a second mounting segment and wherein the hinge trim includes:

a first covering portion overlying at least a portion of the support link;

a second covering portion adjacent the first covering portion overlying at least a portion of the first strap; and a third covering portion adjacent the first covering portion overlying at least a portion of the second strap, wherein the first covering portion moves with the hinge relative to the second covering portion and the third covering portion so as to maintain a barrier surface over one or more pivot points.

3. The hinge trim system defined in claim 2, wherein the second covering portion overlies at least a portion of the first mounting segment.

4. The hinge trim system defined in claim 2, wherein the second covering portion overlies at least a portion of the second mounting segment.

5. The hinge trim system defined in claim 2, wherein a first slip plane is formed between the first covering portion and adjacent interior trim panels, a second slip plane is formed between the second covering portion and adjacent interior trim panels, and a third slip plane is formed between the third covering portion and adjacent interior trim panels.

6. The hinge trim system defined in claim 2, wherein a portion of the first covering portion, the second covering portion, and the third covering portion maintain a covering over a substantial portion of the hinge surfaces as the hinge moves from one position to another.

7. The hinge trim system defined in claim 6, wherein the first covering portion, the second covering portion and the third covering portion are coupled to the hinge.

8. A hinge and hinge trim arrangement, comprising:

a hinge including a support link having a first end pivotally connected to a first strap and having a second end pivotally connected to a second strap, the first strap having a first substantially planar mounting segment and the second strap having a second substantially planar mounting segment, the first and second mounting segments continuously remaining substantially parallel during operation of the hinge system; and a hinge trim system for covering one or more exposed surfaces of the hinge, including:

a first covering portion overlying the support link;

a second covering portion adjacent the first covering portion overlying the first strap; and a third covering portion adjacent the first covering portion overlying the second strap, wherein the first covering portion moves with the hinge relative to the second covering portion and the third covering portion so as to maintain a barrier surface between respective adjacent end portions of the first covering portion, the second covering portion, and the third covering portion and the hinge while simultaneously maintaining a covering over a substantial portion of the hinge surfaces.

9. The hinge trim system defined in claim 8, wherein the first covering portion, the second covering portion and the third covering portion are coupled to the hinge.

10. The hinge trim system defined in claim 8, wherein a first slip plane is formed between the first covering portion and adjacent interior trim panels, a second slip plane is formed between the s second covering portion and adjacent interior trim panels, plane is formed between the third covering portion and adjacent interior and a third slip plane is formed between the third covering portion and adjacent interior trim panels.

11. A method for installing the hinge and hinge trim assembly on an automobile frame, the method comprising:

providing a door to be hinged to an automobile frame;

coupling a hinge to one surface of the door;

coupling the opposite end of the hinge to a portion of the automobile frame;

providing a hinge trim having a covering portion for covering at least a portion of one or more exposed surfaces of the hinge, wherein the covering portion includes one or more covering surfaces overlying the hinge so as to maintain a barrier surface between one or more pivot points and the covering portion, wherein the hinge includes a support link having a first end pivotally connected to a first strap and having a second end pivotally connected to a second strap, the first strap having a first substantially planar mounting segment and the second strap having a second substantially planar mounting segment, the first and second mounting segments continuously remaining substantially parallel during operation of the hinge system.

12. The method of installing defined in claim 11, wherein the hinge trim includes:

a first covering portion overlying the support link;

a second covering portion adjacent the first covering portion overlying the first strap; and a third covering portion adjacent the first covering portion overlying the second strap, wherein the first covering portion moves with the hinge relative to the second covering portion and the third covering portion move so as to maintain a barrier surface between respective adjacent end portions of the first covering portion, the second covering portion, and the third covering portion and the hinge while simultaneously maintaining a covering over a substantial portion of the hinge surfaces.

13. The method of installing a hinge trim system defined in claim 11, wherein a first slip plane is formed between the first covering portion and adjacent interior trim panels, a second slip plane is formed between the second covering portion and adjacent interior trim panels, and a third slip plane is formed between the third covering portion and adjacent interior trim panels.

* * * * *